US008511590B2

(12) United States Patent
Watanabe et al.

(10) Patent No.: US 8,511,590 B2
(45) Date of Patent: Aug. 20, 2013

(54) ELECTROSTATICALLY ATOMIZING DEVICE AND ELECTROSTATICALLY ATOMIZING SYSTEM

(75) Inventors: Hideki Watanabe, Osaka (JP); Yasushi Arikawa, Neyagawa (JP); Akihide Sugawa, Hikone (JP); Takeshi Yano, Kyoto (JP); Hisahito Ono, Hikone (JP); Kouichi Hirai, Hikone (JP); Tomonori Tanaka, Tsu (JP)

(73) Assignee: Panasonic Corporation, Osaka (JP)

( * ) Notice: Subject to any disclaimer, the term of this patent is extended or adjusted under 35 U.S.C. 154(b) by 1038 days.

(21) Appl. No.: 12/092,408

(22) PCT Filed: Nov. 14, 2006

(86) PCT No.: PCT/JP2006/322630

§ 371 (c)(1),
(2), (4) Date: May 1, 2008

(87) PCT Pub. No.: WO2007/058161

PCT Pub. Date: May 24, 2007

(65) Prior Publication Data

US 2009/0289132 A1 Nov. 26, 2009

(30) Foreign Application Priority Data

Nov. 15, 2005 (JP) ..... 2005-330588
Mar. 28, 2006 (JP) ..... 2006-089604

(51) Int. Cl.
*B05B 5/00* (2006.01)

(52) U.S. Cl.
USPC ..... 239/690.1; 239/706

(58) Field of Classification Search
USPC ..... 239/690, 690.1, 705, 706, 707, 289, 239/290, 291, 589, 600, 265.13, 462
See application file for complete search history.

(56) References Cited

U.S. PATENT DOCUMENTS 3,587,967 A * 6/1971 Badger ..... 239/705
3,630,441 A * 12/1971 Felici et al. ..... 239/692
3,735,925 A * 5/1973 Benedek et al. ..... 239/704
4,184,638 A * 1/1980 Ogasawara et al. ..... 239/418

(Continued)

FOREIGN PATENT DOCUMENTS

JP 55-137965 U 10/1980
JP 61-6493 A 1/1986

(Continued)

OTHER PUBLICATIONS

International Search Report for the Application No. PCT/JP2006/322630 mailed Jan. 23, 2007.

(Continued)

*Primary Examiner* — Davis Hwu
(74) *Attorney, Agent, or Firm* — McDermott Will & Emery LLP

(57) ABSTRACT

A high voltage is applied between an emitter electrode in an atomizing barrel and an opposed electrode supported to the atomizing barrel to electrostatically atomize a liquid supplied to the emitter electrode into a mist of charged minute particles. A silencer duct is attached to the front end of the atomizing barrel for reducing noises developed when generating the mist of the charged minute particles. Accordingly, the silencer duct can absorb the noises developed around the emitter electrode and the opposed electrode at immediately downstream thereof for effectively reducing the noises.

19 Claims, 14 Drawing Sheets

(56) References Cited

U.S. PATENT DOCUMENTS

| | | | |
|---|---|---|---|
| 4,605,091 | A | 8/1986 | Iida et al. |
| 5,795,634 | A | 8/1998 | Fukui |
| 2006/0131449 | A1 | 6/2006 | Azukizawa et al. |

FOREIGN PATENT DOCUMENTS

| | | | |
|---|---|---|---|
| JP | 2-168097 | A | 6/1990 |
| JP | 4-371792 | A | 12/1992 |
| JP | 6-167982 | A | 6/1994 |
| JP | 7-133940 | A | 5/1995 |
| JP | 8-111362 | A | 4/1996 |
| JP | 9-89357 | A | 4/1997 |
| JP | 9-217480 | A | 8/1997 |
| JP | 10-56280 | A | 2/1998 |
| JP | 2004-019818 | A | 1/2004 |
| JP | 2004-33875 | A | 2/2004 |
| JP | 2004-358362 | A | 12/2004 |
| JP | 2005-131549 | A | 5/2005 |
| JP | 2005-254208 | A | 9/2005 |
| JP | 2006-61408 | A | 3/2006 |

OTHER PUBLICATIONS

Notification of Reasons for Refusal for Application No. JP 2006-309478 from Japan Patent Office mailed Dec. 21, 2010.

Notification of Reasons for Refusal for Application No. JP 2006-309479 from Japan Patent Office mailed Dec. 21, 2010.

Notification of Reasons for Refusal for Application No. 2009-040655 from Japan Patent Office mailed Feb. 22, 2011.

* cited by examiner

FIG.30
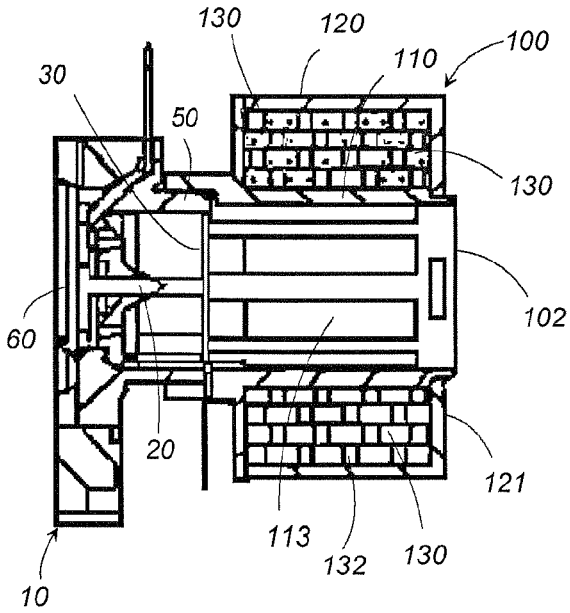
FIG.31
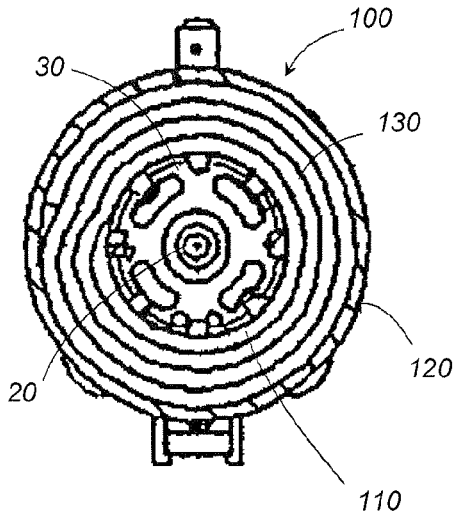
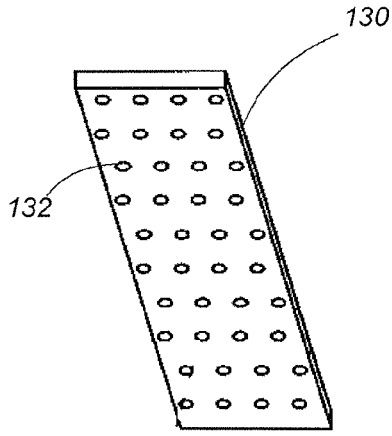
FIG.32

ELECTROSTATICALLY ATOMIZING DEVICE AND ELECTROSTATICALLY ATOMIZING SYSTEM

TECHNICAL FIELD

The present invention relates to an electrostatically atomizing device generating a mist of charged minute liquid particles from water which is supplied onto an emitter electrode by a high voltage applied to the emitter electrode and an opposed electrode, and an electrostatically atomizing system utilizing the device.

BACKGROUND ART

Japanese patent publication no. 2005-131549 A discloses a prior art electrostatically atomizing device. The device includes an emitter electrode, an opposed electrode, a liquid supplying means for supplying water to the emitter electrode, and a high voltage source applying a high voltage between the emitter electrode and the opposite electrode to atomize the water supplied onto the emitter electrode into a mist of charged minute particles which is carried on an ion wind flowing from the emitter electrode towards the opposed electrode and is discharged outwardly. Thus configured electrostatically atomizing device suffers from noises developed upon generation of the mist of the charged minute water particles. Therefore, it is desired to reduce the noises.

DISCLOSURE OF THE INVENTION

In view of the above problem, the present invention has been achieved to provide an electrostatically atomizing device which is capable of reducing the operation noises, yet allowing to discharge the mist of the charged minute particles without causing a hindrance to a flow of the mist of charged minute particles.

The electrostatically atomizing device in accordance with the present invention includes an emitter electrode, a liquid supplying means for supplying a liquid to the emitter electrode, an opposed electrode disposed in an opposed relation to the emitter electrode, an atomizing barrel surrounding the emitter electrode and supporting the opposed electrode, and a high voltage source configured to apply a high voltage between the emitter electrode and the opposed electrode. By application of the high voltage, the liquid supplied to the emitter electrode is electrostatically atomized at a tip of the emitter electrode into a mist of charged minute particles which is discharged from the tip of the emitter electrode to flow through the opposed electrode out of a front end of the atomizing barrel. The feature of the present invention resides in that a silencer duct with a sound absorbing section is provided at the front end of the atomizing barrel in order to pass the mist of the charged minute particles out through the silencer duct. With this result, the noises caused between the emitter electrode and the opposed electrode can be absorbed through the silencer duct immediately downstream of the atomizing barrel, and therefore can be effectively reduced. Further, the silencer duct itself directs the mist of the charged minute particles outwardly, thereby guiding the mist to discharge it in a predetermined direction without causing undue scattering.

Preferably, the atomizing barrel is formed with an air inlet for introducing an outside air, and the silencer duct is prepared in the form of an attachment detachable to the atomizing barrel. The air inlet is located at a suitable location of the atomizing unit to introduce the outside air for generating an air stream on which the mist of the charged minute water particles are carried is flown outwardly. Since the silencer duct is detachable to the atomizing barrel, it can be structured to exhibit a high sound absorbing capability without being largely confined to structural limitations posed to the atomizing barrel, and be expected to give a highly efficient sound absorbing performance.

The silencer duct is preferred to include an outer tube and a perforated inner tube with a sound absorber being held between the outer and inner tubes to constitute the sound absorbing section.

The sound absorber is preferred to be formed in its interior with a sound reflector. The reflector acts to elongate a noise propagation path between the inner and outer tubes so as to increase chances of absorbing the noises, thereby improving a sound absorbing effect within a limited space.

Preferably, the silencer duct has its axis inclined with respect to an axis of the atomizing barrel. In this instance, the silencer duct can absorb noise components of high directivity and restrain the same from leaking outwardly for improving a muffling effect.

Further, the sound absorber is disposed to leave a cavity at its interface with the outer tube or inner tube. With the presence of the cavity, the sound wave reflects repeatedly at the interface to be absorbed thereat for effectively reducing the noise and improving the muffling effect.

The cavity is preferred to include a plurality of grooves extending along and being arranged circumferentially about the axis of the silencer duct. The grooves thus arranged circumferentially at the interface with the outer or inner tube is responsible for successfully entrapping the noises emanating radially from within the inner tube for improved muffling effect. The cavity may be also formed inside of the sound absorber as voids.

For instance, the sound absorber may be made of one or more sound absorbing sheets wound into a tubular shape.

Further, the sound absorber is preferred to be composed of a first sound absorber and a second sound absorber which are configured to absorb sound of different frequency ranges. With this structure, it is possible to reduce the noise over a wide frequency range.

Further, the silencer duct may be configured to have its one portion overlapped with the circumference of the atomizing barrel. In this instance, it is possible to restrain a length of the silencer duct projecting from the front end of the atomizing barrel, giving a compact structure to the electrostatically atomizing device.

The opposed electrode is ring-shaped to be coaxial with a discharge end at the tip of the emitter electrode, and the tip of the emitter electrode and the opposed electrode are arranged along the axis of the atomizing barrel such that the mist of the charged minute particles discharged from the discharge end flows in an outlet passage defined along the axis of the atomizing barrel through the interior of said opposed electrode. The silencer duct may be formed with a discharge passage which crosses with the outlet passage. In this instance, the mist of the charge minute particles discharged from the atomizing barrel can be guiding in an inclined direction within the silencer duct, thereby assuring to effectively reduce the noises of high directivity.

Besides, it is possible to adopt a structure in which the silencer duct is formed at its rear end with an inlet port having a diameter larger than the inside diameter of the atomizing barrel, and the silencer duct has its inside diameter smaller towards its outlet port at the front end thereof. Also in this regards, an improved muffling effect is expected due to thus continuously varying inside diameter.

Alternatively or in addition to the use of the sound absorber, the silencer duct may be formed intermediate its length with an expansion chamber or resonant chamber as constituting the sound absorbing section.

The present invention further discloses an electrostatically atomizing system incorporating the above described electrostatically atomizing device. The system includes a housing accommodating a fan configured to generate a forced air flow, and forming a straight flow channel for directing the forced air flow. The electrostatically atomizing device is disposed within the flow channel. The silencer duct is configured to have a straight discharge channel which flows the charged minute particles and is inclined with respect to the flow channel. Thus, the noise leaked from the silencer duct can be directed in a direction different from a discharging direction of the mist of the charged minute particles, thereby reducing the leakage of the noises into an environment of using the mist of the charged minute particles.

Further, the silencer duct may have its discharge channel inclined with the flow channel of the forced air flow in order to minimize the leakage of the noise into the environment.

BRIEF DESCRIPTION OF THE DRAWINGS

FIG. 30 is a longitudinal section view of a twelfth modification of the above silencer duct;

FIG. 31 is a sectional side view of the above silencer duct;

FIG. 32 is a perspective view of a sound absorbing sheet used in the above silencer duct;

BEST MODE FOR CARRYING OUT THE INVENTION

Figure 1:
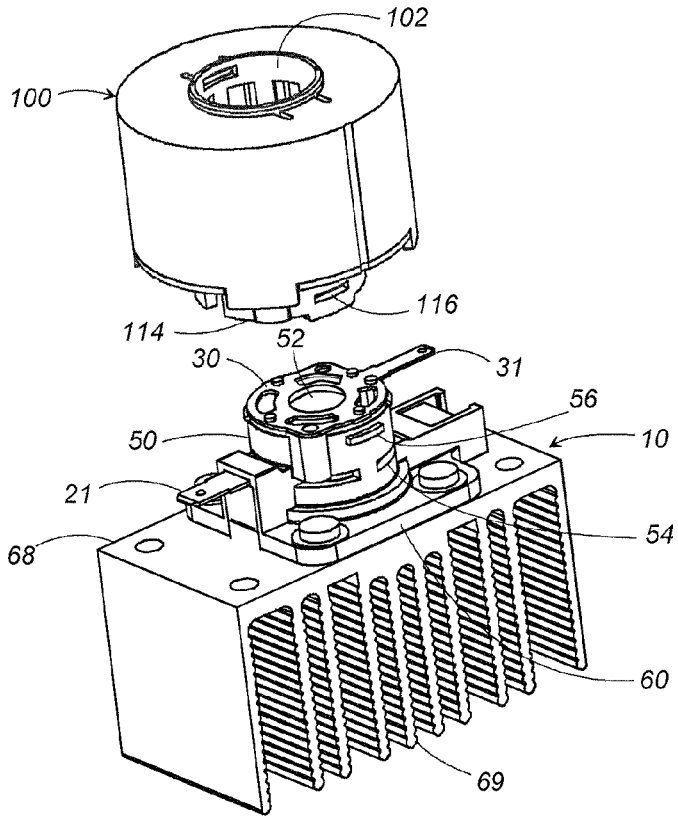
FIG. 1 is an exploded perspective view of an electrostatically atomizing device in accordance with an embodiment of the present invention.
Figure 2:
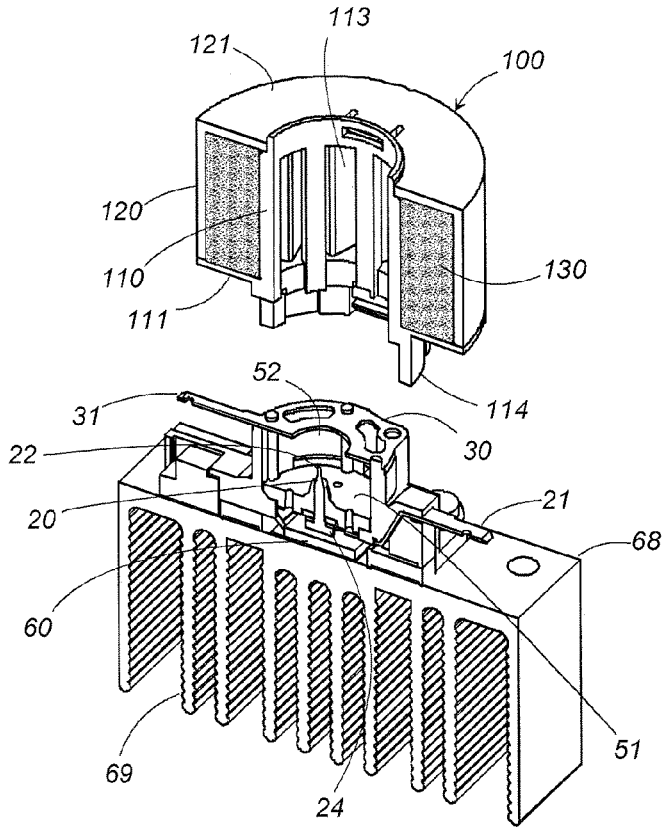
FIG. 2 is a partly cutout exploded perspective view of the above electrostatically atomizing device.
Figure 3:
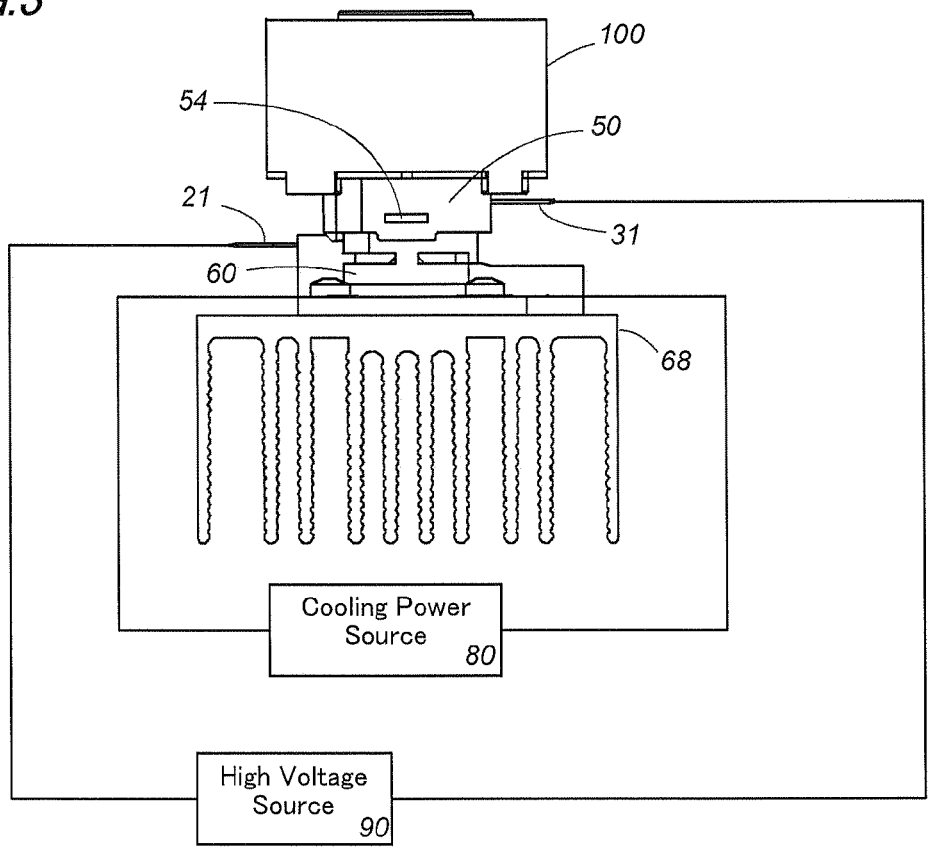
FIG. 3 is a front elevation of the above electrostatically atomizing device.
Figure 4:
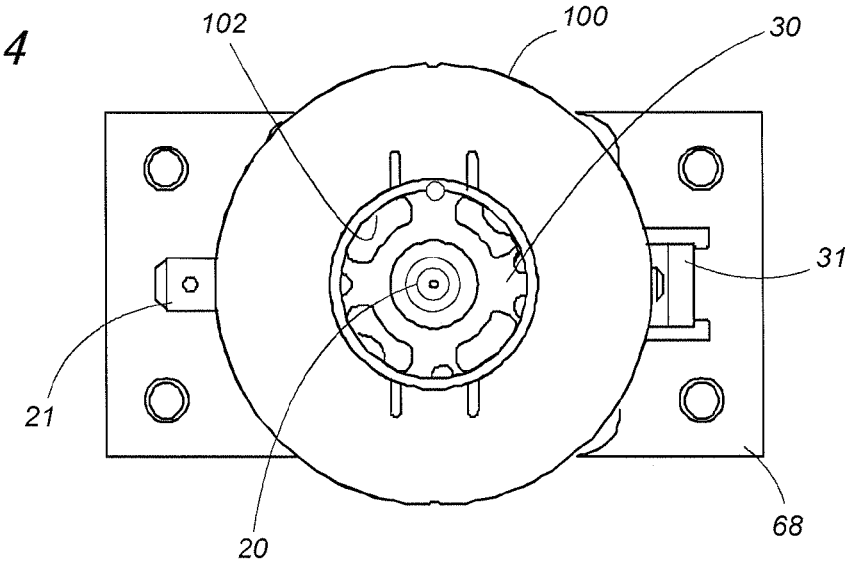
FIG. 4 is a top view of the above electrostatically atomizing device.

Now, a reference is made to the attached drawings to explain an electrostatically atomizing device in accordance with one embodiment of the present invention. As shown in FIG. 1 to FIG. 4, the electrostastically atomizing device includes an electrostatically atomizing unit 10 and a silencer duct 100 which is detachably attached to the electrostatically atomizing unit 10. The electrostatically atomizing unit 10 includes an atomizing barrel 50 holding an emitter electrode 20, an opposed electrode 30, and a heat exchanger 60. The emitter electrode 20 is disposed on a center axis of the atomizing barrel 50, is provided with its rear which is fixed to an upper part of the heat exchanger 60 and is provided with its tip which projects into the atomizing barrel 50. The opposed electrode 30 is formed into the ring-shaped to have a circular window 32. The opposed electrode 30 is fixed to the front end of the atomizing barrel 50 with the center of the circular window aligned with the center axis of the atomizing barrel 50. The opposed electrode 30 is disposed along the axial direction of the atomizing barrel 50, is spaced from the discharge end of the emitter electrode and disposed in an opposed relation to the emitter electrode 20. The circular window 32 defines a discharge port 52 at the front end of the atomizing barrel 50. The emitter electrode 20 and the opposed electrode 30 are connected to an external high voltage source 90 via an electrode terminal 21 and earth terminal 31, respectively. The high voltage source 90 includes a transformer and is designed to apply a predetermined voltage between the emitter electrode 20 and the opposed electrode 30. The high voltage source 90 applies the high voltage (for instance, −4.6 kV) to the emitter electrode 20 and generates the high voltage electric field between the discharge end of the emitter electrode 20 and the inner circumferential edge of the circular window of the grounded opposed electrode 30. And as mentioned later, the high voltage source 90 charges the water which is supplied onto the emitter electrode 20 with the electrostatic action and discharges a mist of charged minute water particles from the discharge end 22.

When the high voltage is applied between the emitter electrode 20 and the opposed electrode 30, a Taylor cone is formed locally on a surface of the water by a Coulomb force which is generated between the water which is held at a tip of the discharge end 22 of the emitter electrode 20 and the opposed electrode 30. Then, electric field intensity becomes large due to the electric charges which is concentrated to the tip of the Taylor cone. The Coulomb force which is generated at the tip of the Taylor cone becomes large and develops the Taylor cone larger. A large amount of the mist of charged minute water particles of nanometer sizes is generated by repetition of the disintegration of the Taylor cone (Rayleigh breakup) when the coulomb force becomes larger than a surface tension of the water. The mist is discharged from an outlet port 52 through the opposed electrode 30 together with an airflow being caused by an ion wind which flows from the emitter electrode 20 toward the opposed electrode 30. The atomizing barrel 50 is provided with plural air inlets 54 in a peripheral wall of a rear end of the atomizing barrel 50. The plural air inlets 54 take in the air and keep the above air flow.

The atomizing barrel is provided with its bottom where a heat insulating member 51 is placed. The heat insulating member is attached to the heat exchanger 60 which includes the Peltier-effect thermoelectric-module. A cool side of the heat exchanger 60 is coupled with the emitter electrode 20 and cools the emitter electrode 20 to a temperature of dew point or below. The cooled emitter electrode 20 condenses the water from the moisture in the ambient air onto the emitter electrode 20. The heat exchanger 60 defines a liquid supplying means which supplies the water to the emitter electrode 20. The heat exchanger 60 includes a pair of conductive circuit boards and plural thermoelectric elements which are connected in series between the conductive circuit boards and cools the emitter electrode 20 at the rate which is determined by the applied variable voltage from the external cooling power source 80. One of the conductive circuit boards being a cooling side is thermally coupled with a flange 24 of the rear end of the emitter electrode 20, while another conductive circuit board which is a heat radiating part is thermally coupled with a radiator plate 68. The radiator plate 68 is fixed to the rear end of the atomizing barrel 50 and holds the heat exchanger 60 between itself and the heat insulating member 51 which is placed at the bottom of the atomizing barrel 50. The radiating plate 68 is provided with a radiating fin 69 for promoting the radiation. The cooling power source 80 controls the heat exchanger 60 to maintain the emitter electrode 20 at a suitable temperature according to the ambient temperature and the ambient moisture. Namely, the cooling power source 80 controls the heat exchanger 60 to maintain the emitter electrode 20 at the suitable temperature for condensation of sufficient amount of water onto the emitter electrode 20.

The silencer duct 100 is an attachment which is attached to the tip of the electrostatically atomizing unit 10 and discharges the mist of charged minute water particles with reducing noises caused when a mist of charged minute water particles is generated. The silencer duct 100 includes an inner tube 110 which is provided with openings in both ends of the axial direction, the outer tube 120 which surrounds the inner tube, and a sound absorber. The sound absorber 130 is held between the inner tube 110 and the outer tube 120. A peripheral wall of the inner tube 110 is provided with plural apertures 113. The plural apertures 113 lead to the sound absorber 130 and direct the sound wave to the sound absorber 130. The inner tube 110 is provided with a connecting tube 114 which is projected from the rear end. The connecting tube 114 is formed with grooves 116. While, the front end of the atomizing barrel 50 is formed with projecting edges 56. The projecting edges 56 are detachably fitted in grooves of the connecting tube 114. By fitting the projecting edge 56 in grooves 116 of the connecting tube 114, the silencer duct 100 is coaxially connected to the atomizing barrel 50. The opening at the front end of the inner tube 110 is provided as a discharge port 102 with almost the same diameter as the outlet port of the atomizing barrel 50. The discharge port 102 discharges the mist of charged minute water particles. A Front end face and a rear end face of the space between the outer tube 120 and the inner tube 110 are closed by a front wall 121 and a rear wall 111, respectively.

Figure 5:
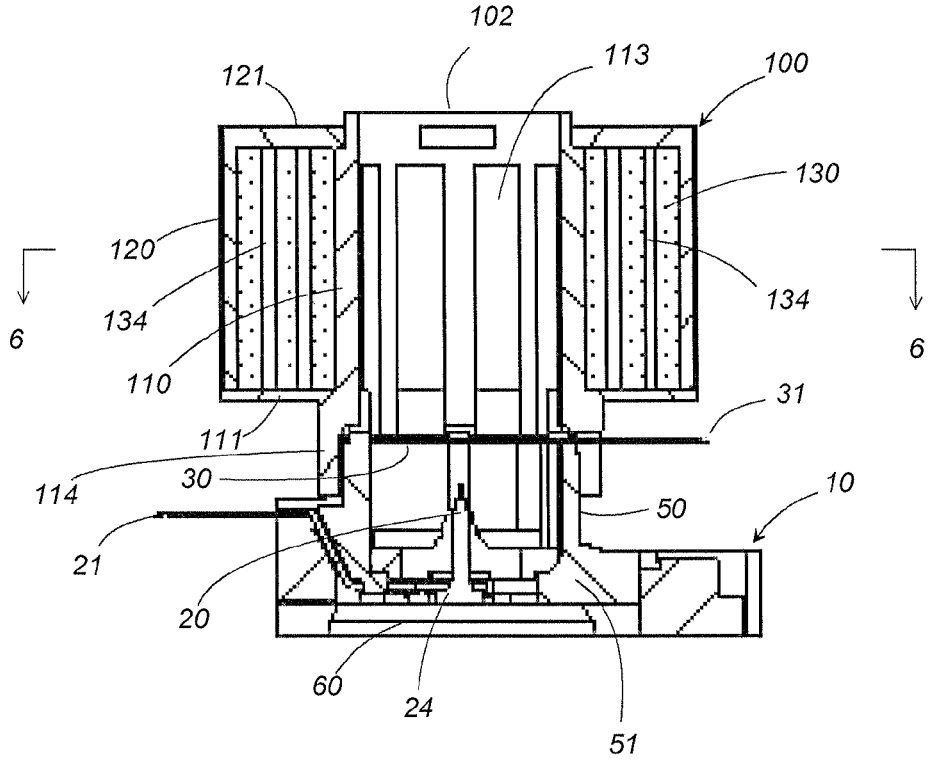
FIG. 5 is a vertical section of the above electrostatically atomizing device.
Figure 6:
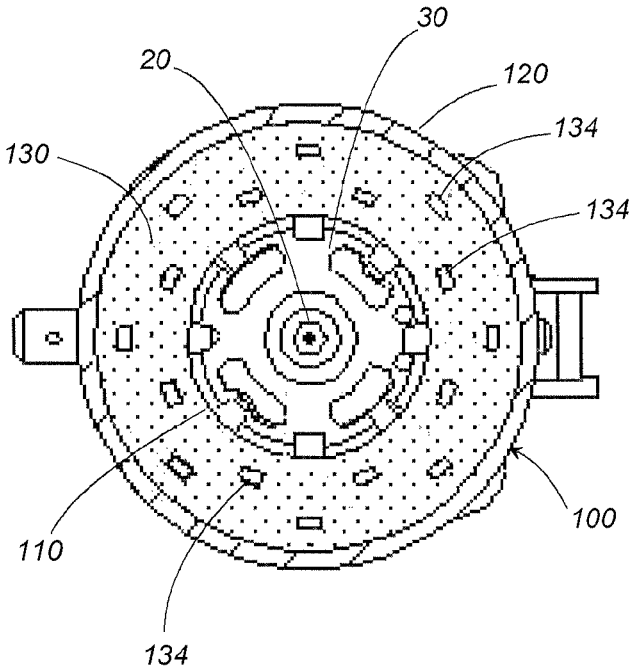
FIG. 6 is a 6-6-line cross sectional view of the above electrostatically atomizing device shown in FIG. 5.

As shown in FIG. 5 and FIG. 6, the sound absorber 130 may be formed in its interior with plural lines of reflectors 134 which are arranged along the axis direction of the silencer duct 100. The reflectors 134 are arranged in inner rows and outer rows at equal intervals along the circumferential direction around the axis of the silencer duct 100. The inner reflectors and the outer reflectors are arranged alternately. In this way, by the sound absorber 130 formed in its interior with plural lines of reflectors 134, the sound absorber is provided with a long noise propagation path. Therefore the silencer duct 100 promotes the attenuation of the sound waves and shows the high noise reduction effect. As the reflectors 134, a reflector which is made of polycarbonate and polyurethane resin is used. As the reflectors instead of the bar-shaped reflectors which are shown in the drawings, various shapes such as a spherically-shaped reflector, a needle-shaped reflector, and a scale-shaped reflector are able to use.

Meanwhile, the silencer duct 100 has the effect to discharge the mist of charged minute water particles with rectifying it as well as the effect to attenuate the noise. More specifically, by flowing the ion wind from the emitter electrode 20 through the opposed electrode 30 to the silencer duct 100 and charging the inner tube 110 and the sound absorber 130 electrostatically, the silencer duct 100 rectifies the mist of charged minute water particles along the axial direction of the silencer duct 100 and smoothly discharges the mist of charged minute water particles to the outside without staying the mist of charged minute water particles in the silencer duct 100.

Figure 7:
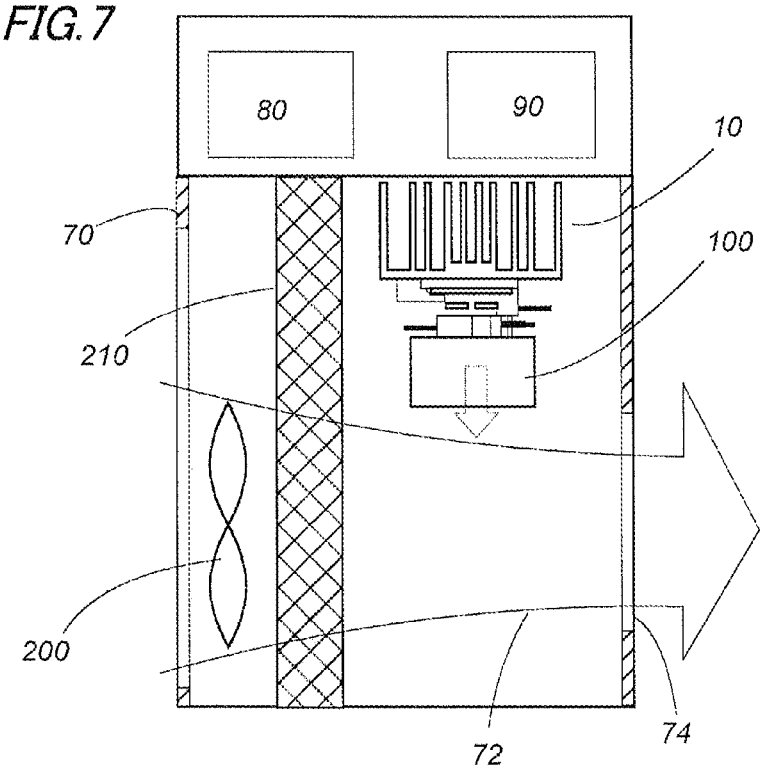
FIG. 7 is a schematic view of an electrostatically atomizing system incorporating the above electrostatically atomizing device.

FIG. 7 shows the electrostatically atomizing system which incorporates the above electrostatically atomizing device. In this system, a housing 70 incorporates the electrostatically atomizing device with a fan 200, the above high voltage source 90 and the above cooling voltage source 80. The electrostatically atomizing device discharges the mist of charged minute water particles to a flow channel 72 for a forced air flow which is generated by the fan 200 and supplies the mist of charged minute water particles to the outside environment of the housing 70. In this instance, as shown in the figure, the silencer duct 100 of the electrostatically atomizing device is configured to have the axial direction of the silencer duct 100 which is intersected with the air flow of the flow channel. Therefore, the electrostatically atomizing system reduces leakage of the high directional noises which cannot be absorbed by the silencer duct 100 to the environment. The downstream side of the fan 200 is provided with a dust prevention filter 210. The dust prevention filter 210 generates an air flow of clean air and supplies the clean air to the electrostatically atomizing device. The above mentioned electrostatically atomizing system is used as an air cleaner.

Figure 8:
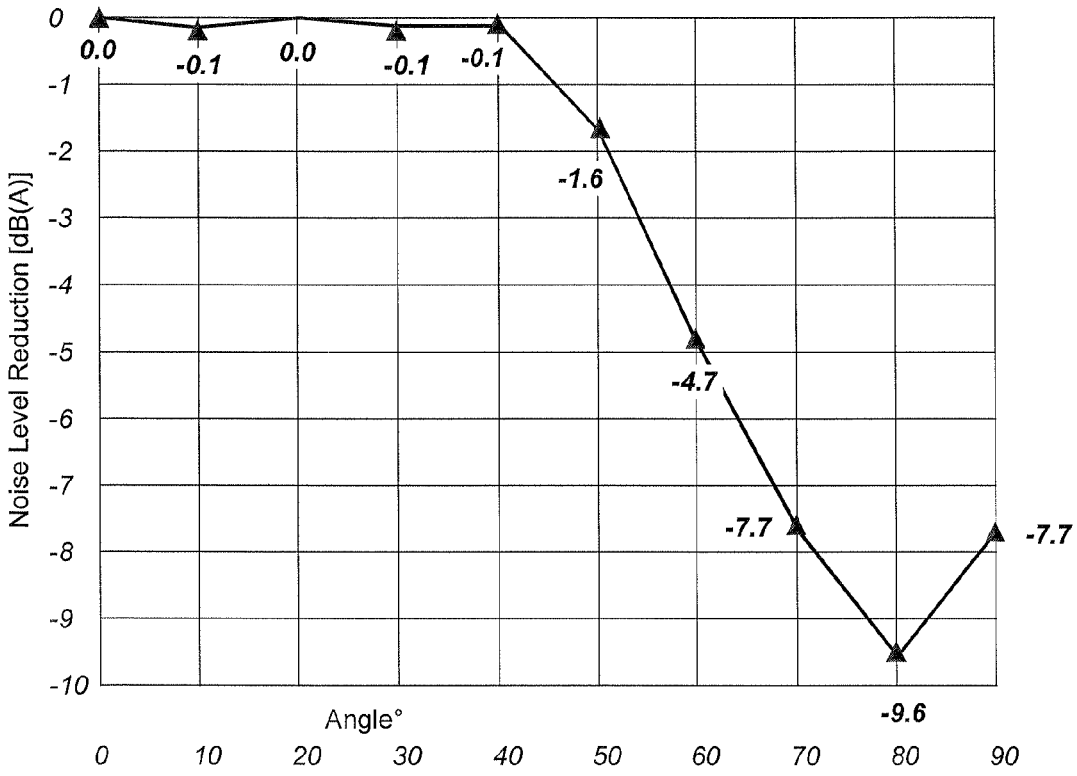
FIG. 8 is a graph showing a relation between an inclination angle of a direction of the silencer duct with respect to a direction of a flow channel and a reducing quantity of a noise level in above electrostatically atomizing system.

FIG.8 shows an amount of noise level reduction according to an inclination angle in an axial direction of silencer duct 100. The silencer duct 100 includes the inner tube 110, the outer tube 120 and the sound absorber 130. The inner tube 110 has 20 mm diameter and 20 mm length, and is formed with the apertures 113. The outer tube 120 has 40 mm diameter and 20 mm length. The sound absorber 130 is made of EDPM series continuous resin foam. The amount of noise level reduction (dB (A)) is measured at the location that is spaced 30 cm away from the discharge port 102 of the silencer duct 100. As a result, by the silencer duct 100 which is placed with the inclination angles of 40 and 90 degrees, an effect of the noise level reduction is able to increase. In the electrostatically atomizing system which incorporated the above electrostatically atomizing device, by the silencer duct 100 which is placed to have its axial direction inclined to the direction of the forced air flow being directed to the usage environment from the fan 200 by 40-90 degrees, the silencer duct 100 reduces the noise to the usage environment.

Figure 9:
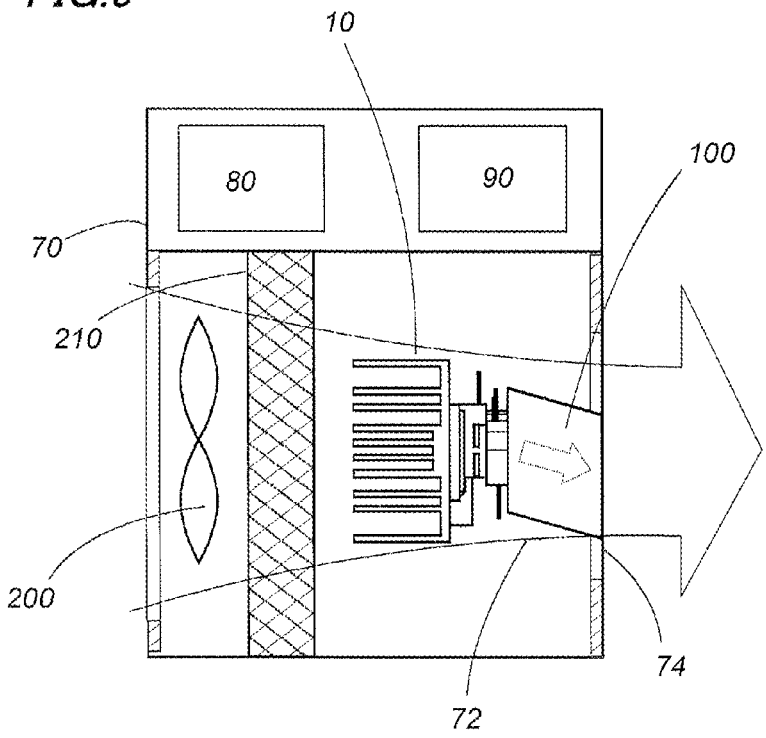
FIG. 9 is a schematic view of another modification of the above electrostatically atomizing system.

FIG. 9 shows a schematic view of another modification of an electrostatically atomizing system. In FIG. 9, the electrostatically atomizing device is made up of the silencer duct 100 which is inclined with respect to the axial direction of the atomizing barrel 50, is placed at the flow channel of the forced air flow, is placed with its axial direction which is aligned with the air flow direction of the forced air flow. Above mentioned inclination angle is achieved by the electrostatically atomizing system shown in FIG. 9.

Figure 10:
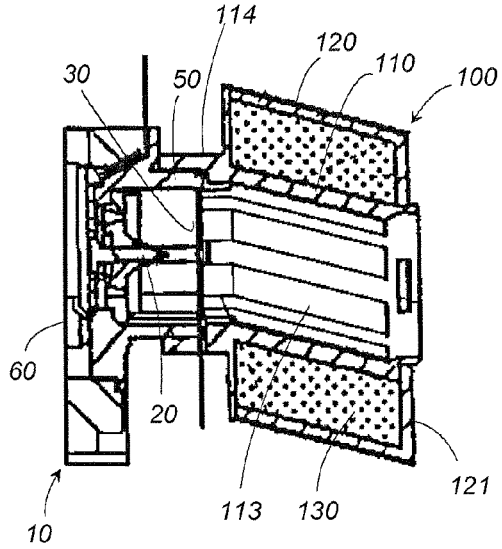
FIG. 10 is a longitudinal section view of a first modification of the silencer duct using the above electrostatically atomizing system.
Figure 11:
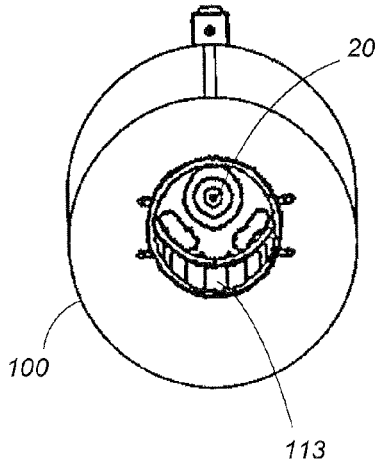
FIG. 11 is a sectional side view of the above silencer duct.

FIG. 10 and FIG. 11 show a first modification of the inclined silencer duct 100. The inner tube 110 and the outer tube 120 are configured to have its axial directions which are inclined by an inclination angle of 10 and 20 degree with respect to the axial direction of the atomizing barrel 50. The other elements are the same in above embodiment. The other elements are the same in above embodiment.

Figure 12:
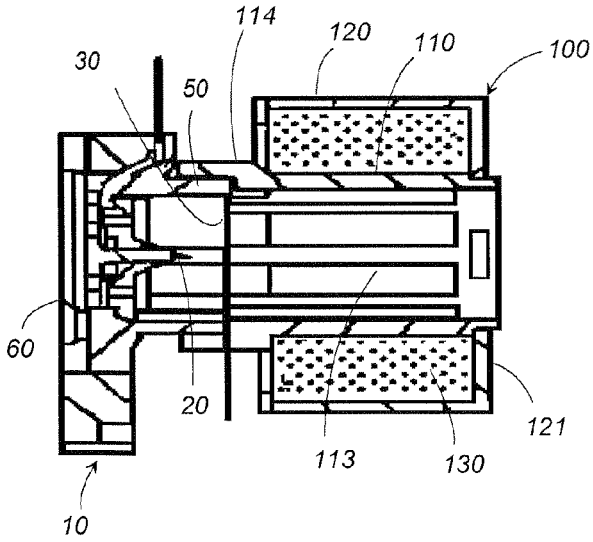
FIG. 12 is a longitudinal section view of a second modification of the silencer duct using the above silencer duct.
Figure 13:
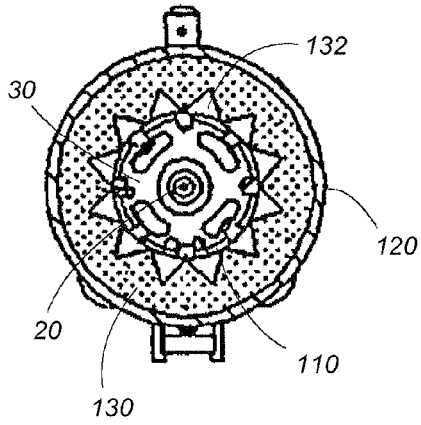
FIG. 13 is a sectional side view of the above silencer duct.

FIG. 12 and FIG. 13 show a second modification of the silencer duct 100. The sound absorber 130 is formed with the plural grooves 132. The grooves 132 are formed at the inter face between the inner tube and the sound absorber 130 and are continuously formed along the circumferential direction. The silencer duct 100 increases the sound absorbing properties by the grooves 132. The grooves 132 have triangular cross section and extend the axial direction and throughout the whole length.

Figure 14:
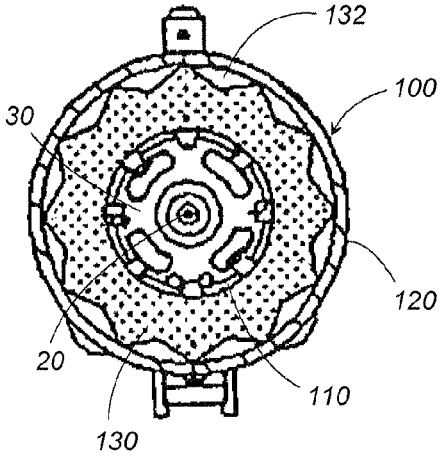
FIG. 14 is a sectional side view of a third modification of the above silencer duct.
Figure 15:
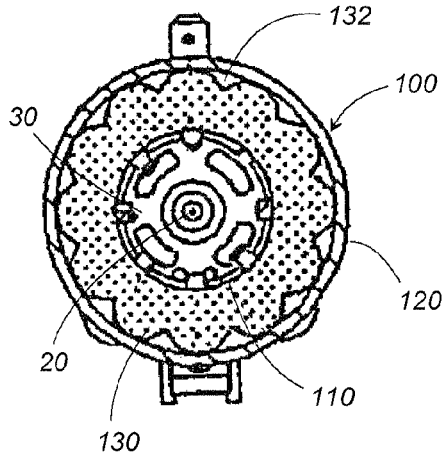
FIG. 15 is a sectional side view of a fourth modification of the above silencer duct.

FIG. 14 and FIG. 15 show a third modification and a fourth modification of the silencer duct 100, respectively. The sound absorber 130 is formed with the grooves 132. The grooves 132 are formed at the interface between the sound absorber 130 and the outer tube 120 and are continuously formed along the circumferential direction. In the modification which is shown in FIG. 14, the grooves 132 have a triangular cross section. In the modification which is shown in FIG. 15, parts where the sound absorber 130 makes contact with the outer tube 120 are formed into curves. The depths of the grooves 132 are determined on the basis of the noise frequency. In a case to attenuate the noise with a frequency of 1 kHz or more, 6 mm or more depth of the groove 132 is preferable.

Figure 16:
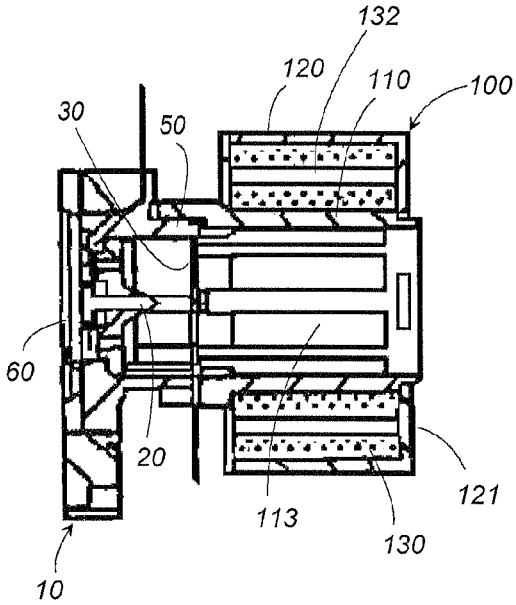
FIG. 16 is a longitudinal section view of a fifth modification of the above silencer duct.
Figure 17:
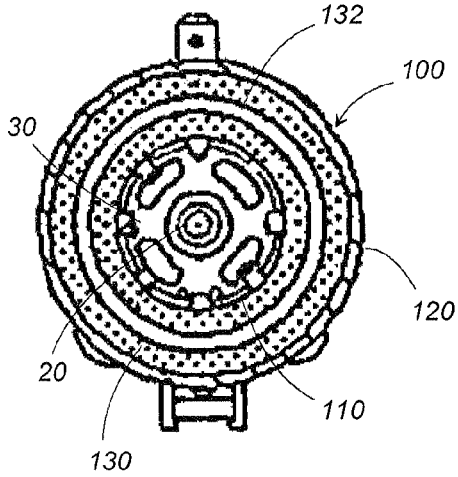
FIG. 17 is a sectional side view of the above silencer duct.

FIG. 16 and FIG. 17 show a fifth modification of the silencer duct 100. The sound absorber 130 is formed with a ring-shaped cavity 132 at the intermediate part of the radial direction of the sound absorber 130. The cavity 132 is formed throughout the whole length of axial direction and divides the sound absorber 130 to an inside member and an outside member. An interface between the cavity 132 and the sound absorber 130 reflects the constant quantity of the sound wave and absorbs the sound wave. In addition, by using the inside member and the outside member which respectively have different absorption frequency ranges, the noise of the wide frequency range are able to be reduced.

Figure 18:
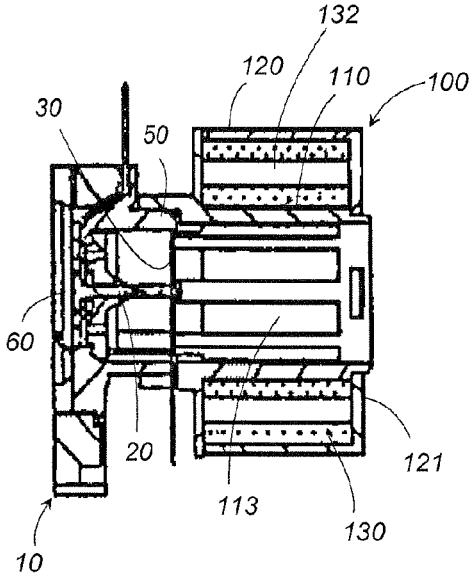
FIG. 18 is a longitudinal section view of a sixth modification of the above silencer duct.
Figure 19:
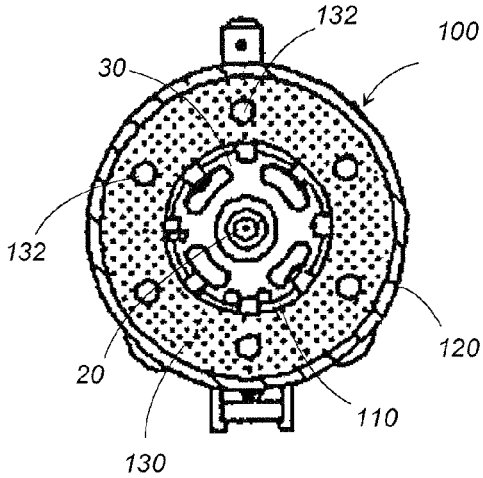
FIG. 19 is a sectional side view of the above silencer duct.

FIG. 18 and FIG. 19 show a sixth modification of the silencer duct 100. The sound absorber 130 is formed with plural cavities 132. The plural cavities 132 are formed along the circumferential direction inside of the sound absorber 130, are formed at equal distances, and extend throughout the whole length of the axial direction of the silencer duct 100.

Figure 20:
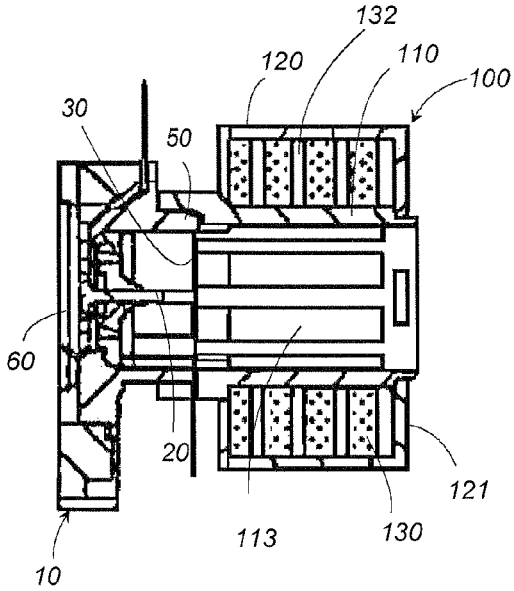
FIG. 20 is a longitudinal section view of a seventh modification of the above silencer duct.
Figure 21:
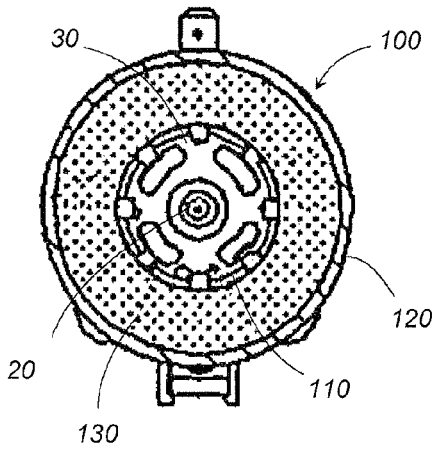
FIG. 21 is a sectional side view of the above silencer duct.

FIG. 20 and FIG. 21 show a seventh modification of the silencer duct 100. The sound absorber 130 is formed with plural cavities 132. The plural cavities 132 extend the radial direction of the silencer duct 100 and formed inside of the sound absorber 130.

Figure 22:
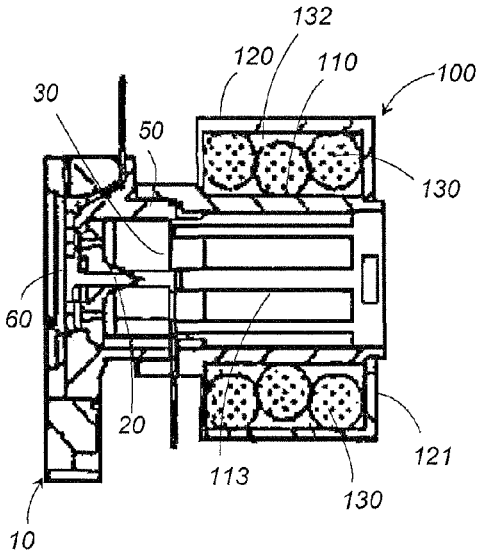
FIG. 22 is a longitudinal section view of a eighth modification of the above silencer duct.
Figure 23:
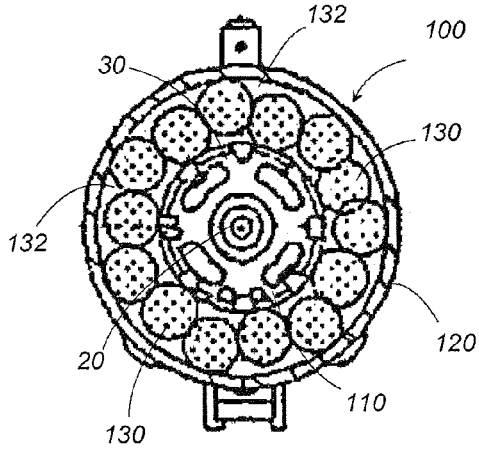
FIG. 23 is a sectional side view of the above silencer duct.

FIG.22 and FIG.23 show an eighth modification of the silencer duct 100. The silencer duct 100 is filled with ball-shaped sound absorbers 130 and is provided with voids 132 which are formed between the ball-shaped sound absorbers 130. Wool-like metal, glass wool and polyethylene urethane foam are suitable as ball-shaped sound absorbers 130.

Figure 24:
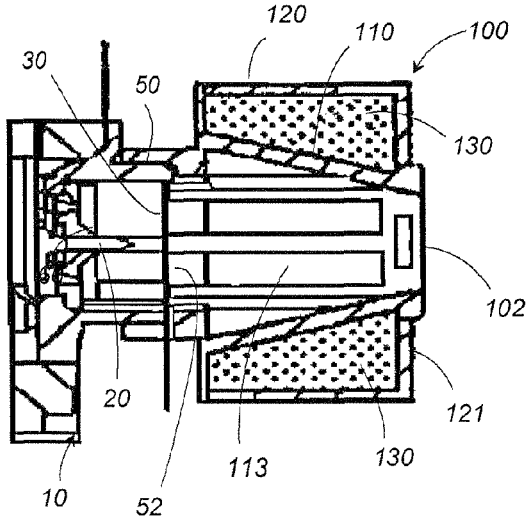
FIG. 24 is a longitudinal section view of a ninth modification of the above silencer duct.
Figure 25:
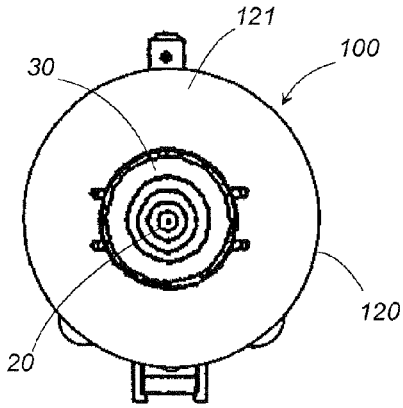
FIG. 25 is a sectional side view of the above silencer duct.

FIG. 24 and FIG. 25 show a ninth modification of the silencer duct 100. The inner tube 110 is formed into a tapered shape and increases the effect of the noise reduction. The inner tube 110 has its rear end which is connect with the front end of the atomizing barrel 50. The rear end of the inner tube 110 has a diameter larger than the outlet port 52. The inner tube 110 has an inner diameter which becomes gradually smaller to the discharge port 102. The inner tube 110 has the inclination angles of 20 and 30 degrees. The discharge port 102 has a diameter which is almost the same as the diameter of the front end of the outlet port 52.

Figure 26:
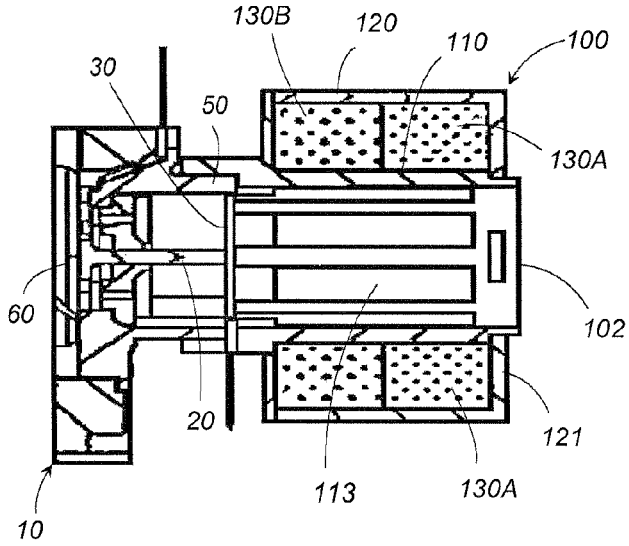
FIG. 26 is a longitudinal section view of a tenth modification of the above silencer duct.
Figure 27:
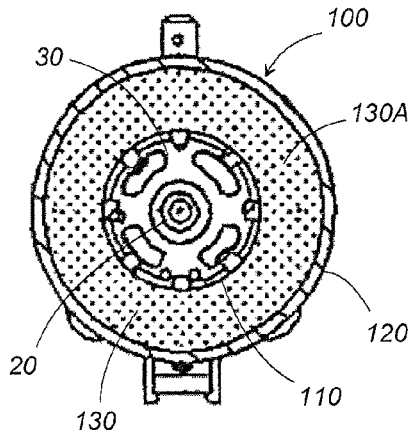
FIG. 27 is a sectional side view of the above silencer duct.

FIG. 26 and FIG. 27 show a tenth modification of the silencer duct 100. The silencer duct 110 is provided with the different types of sound absorbers 130A and 130B which are arranged along the axial direction of the silencer duct 100. The sound absorbers 130A and 130B have different properties of sound absorption and absorb the sound of different frequency range.

Figure 28:
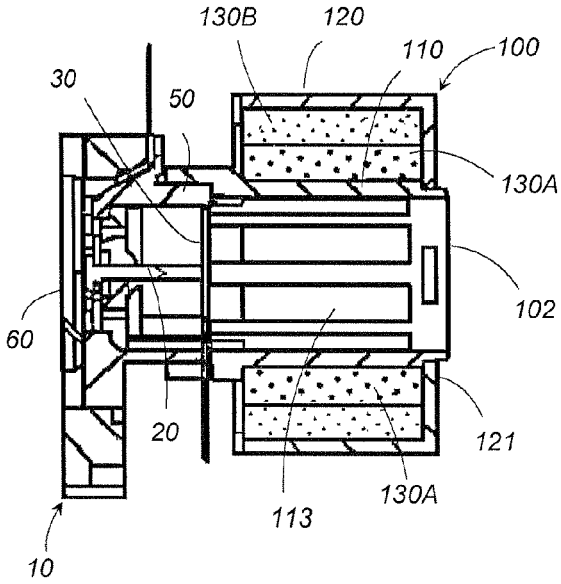
FIG. 28 is a longitudinal section view of an eleventh modification of the above silencer duct.
Figure 29:
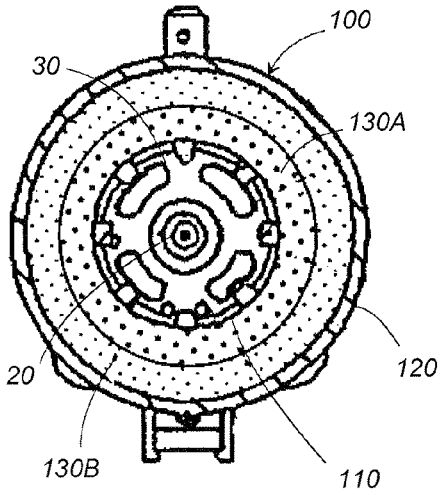
FIG. 29 is a sectional side view of the above silencer duct.

FIG.28 and FIG.29 show an eleventh modification of the silencer duct 100. The different types of the sound absorber 130A and 130B are arranged along the radial direction. In the case of using the sound absorbers of the different types, with consideration of ozone which is generated according to the electrostatically atomizing effect, it is preferable to arrange the sound absorbers at suitable location. As for the inner sound absorber 130A, the sound absorber which is made of resin which has a good resistance to ozone such as the EPDM series continuous resin foam is preferable. As for the outer sound absorber 130B, the sound absorber which is made of the resin which does not have a good resistance to ozone but has a good degree of sound absorption such as urethane series continuous resin foam is preferable. Examples of the sound absorber with the good resistance to ozone include the wool-like metal and glass wool. While, in consideration of the exposure by the mist of charged minute water particles, as for the inner absorber 130A, it is preferable to use the sound absorber which is made of the material which has the resistance to water. Examples of the sound absorber with the good resistance to water include the wool-like metal, glass wool, polyether series urethane foam and diatomite with humidity conditioning properties. By combining and arranging the above sound absorbers, it is possible to prevent the problems to deteriorate the sound absorber by the ozone and to deteriorate the hydrolysis by the mist of charged minute water particles. In addition, by providing the inner sound absorber 130A with a catalyst which has decompose properties, the silencer duct 100 may absorb the noise and reduce the amount of the ozone being generated.

FIG. 30 and FIG. 31 show a twelfth modification of the silencer duct 100. The silencer duct 100 includes the inner tube 110, the outer tube 120, and a sound absorbing sheet 130 shown in FIG. 32. The sound absorbing sheet 130 is wound and is formed into a tubular shape, is held between inner tube 110 and the outer tube 120 and filled the gap between the inner tube 110 and the outer tube 120. The sound absorbing sheet 130 is formed with plural perforations. The plural perforations are uniformly arranged between the inner tube 110 and the outer tube 120 and increase the effect of the noise reduction. A sound absorber which comprises the plural sound absorbing sheets 130 being laminated is also able to use as the above sound absorber.

Figure 33:
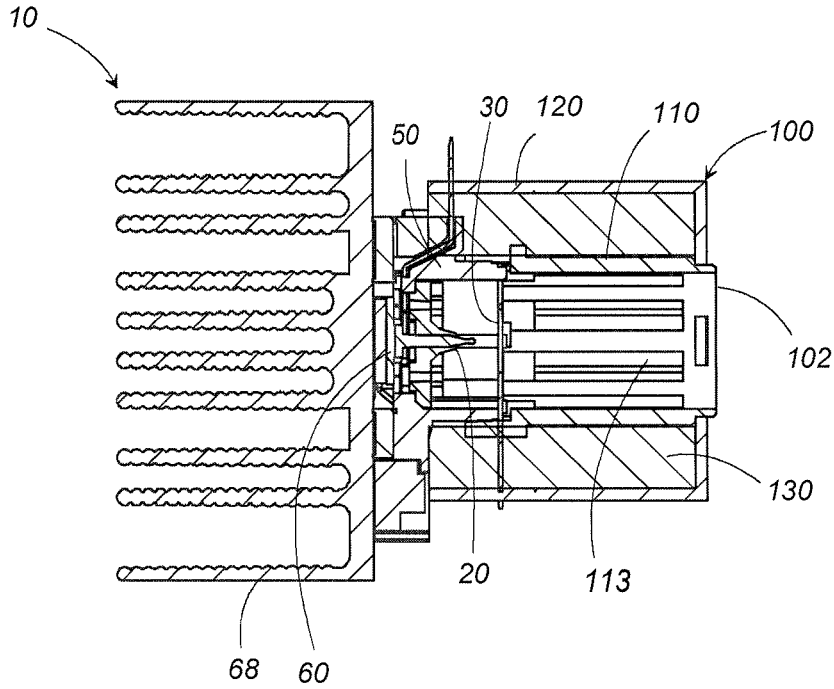
FIG. 33 is a longitudinal section view of the thirteenth modification of the above silencer duct.
Figure 34:
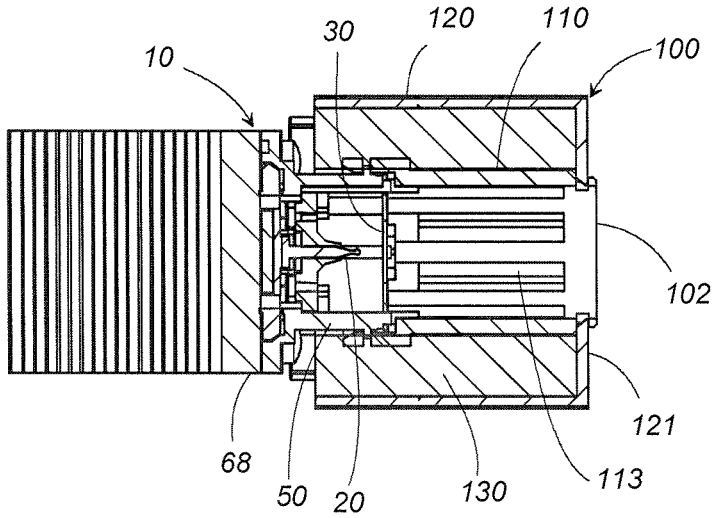
FIG. 34 is a longitudinal section view of the above silencer duct.

FIG. 33 and FIG. 34 show a thirteenth modification of the silencer duct 100. By the silencer duct 100 which is configured to have its rear end overlapped with the circumference of the atomizing barrel 50, the noise reduction effect is increased. In this case, the noise is considerably reduced by forming the rear end of the inner tube 100 into a connection tube which is an insertion part of the front end of the atomizing barrel 50, by surrounding the outer tube 120 with the rear part of the atomizing barrel 50 with the exception of the air inlet 54, by covering the atomizing barrel with the sound absorber 130 which is filled between the inner tube 110 and outer tube 120 and by surrounding with the sound absorber 130 throughout the part which is a generating source of noise from the emitter electrode 20 and the opposed electrode 30. Examples of sound absorbers include the each element which is used in above modifications. In this configure, it is possible to achieve the downsizing of the electrostatically atomizing device with the reduction of the protruding quantity of the front side of the atomizing barrel 50 while showing the good effect of noise reduction.

Figure 35:
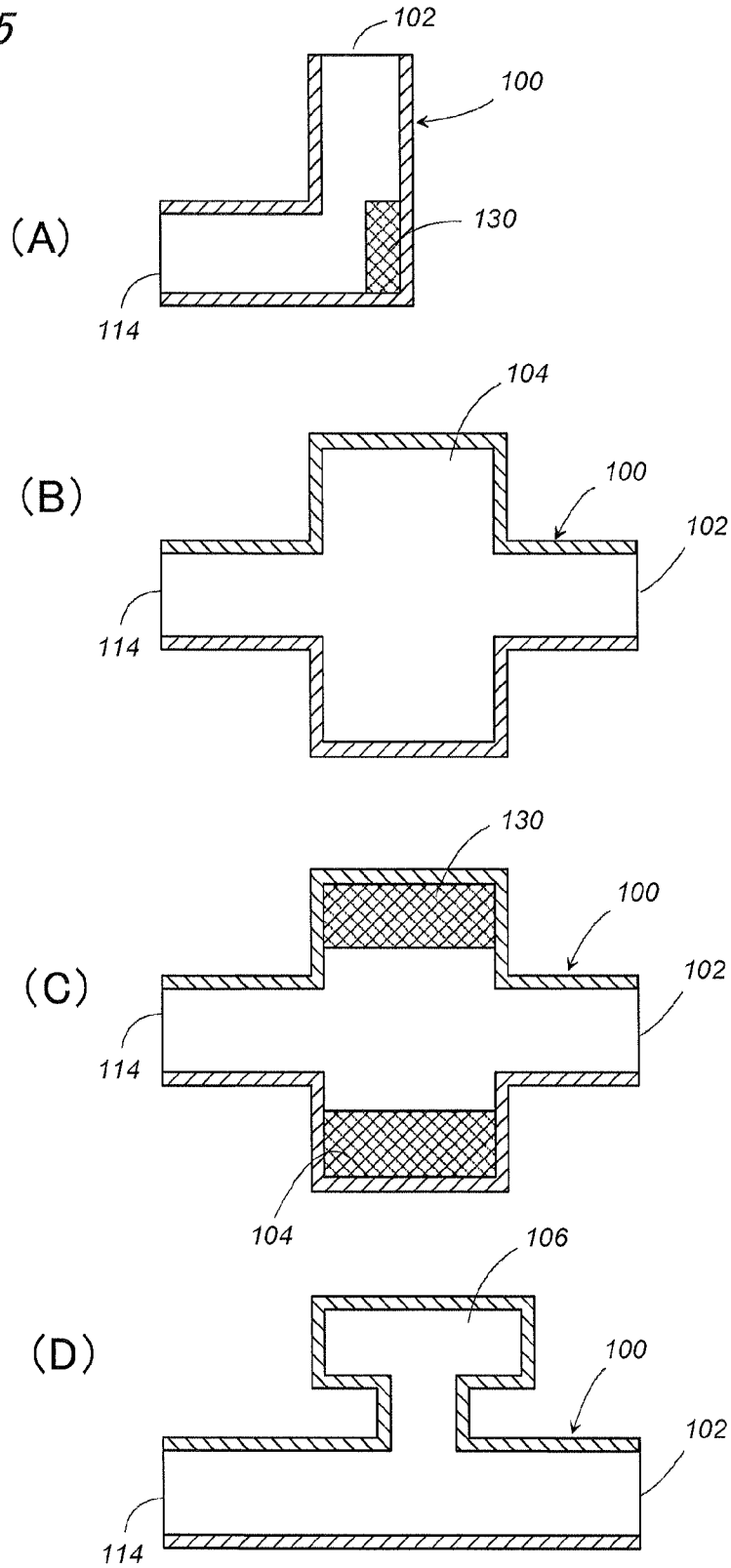
FIG. 35(A) (B) (C) (D) are schematic views of yet another modification of the above silencer duct.

Examples of the silencer duct 100 include the constitutions shown in FIG. 35(A), (B), (C), and (D) as well as above mentioned constitutions. The silencer duct 100 shown in FIG. 35(A) is bent at a 90 degree, is configured to have its rear end which is formed into the connecting tube 114 for connecting to the atomizing barrel 50 and is configured to have its front end which is formed into the discharge port 102. The sound absorber 130 is placed at the bend section. The silencer duct 100 shown in FIG. 35(B) is configured to have its middle part being formed into an expansion chamber 104 having a diameter larger than the rear end of the connecting tube 114 and the front end of the discharge port. The expansion chamber 104 defines the sound absorbing part which shows the effect of noise reduction. The silencer duct 100 shown in FIG. 35(C) includes the expansion chamber 104 which has the sound absorber 130 inside of the expansion chamber 104 and improves the effect of the sound absorbing. The silencer duct 100 which is shown in FIG. 35(D) is configured to have its middle part which is formed into a resonance chamber 106 and reduces the noise. Furthermore, as the silencer duct 100, by combining the above shown elements, the excellent effect of the sound absorbing is shown.

The embodiments shown in the figures show the silencer duct 100 which has a cross section of round shape as for example. But the invention is not to be considered limited to what is shown in the figures. Examples of the shapes of the silencer duct 100 include the ellipse and tetragon. In addition, the atomizing barrel 50 being integrally formed with the silencer duct 100 has the usual effects of the above embodiments.

The invention claimed is:

1. An electrostatically atomizing device comprising:

an emitter electrode;

a liquid supplying means for supplying a liquid to said emitter electrode;

an opposed electrode disposed in an opposed relation to said emitter electrode;

an atomizing barrel surrounding said emitter electrode and supporting said opposed electrode;

a high voltage source configured to apply a high voltage between said emitter electrode and said opposed electrode so as to atomize the liquid supplied to the emitter electrode at a tip of the emitter electrode into a mist of charged minute particles which is discharged from the tip of the emitter electrode to flow through said opposed electrode out of a front end of said atomizing barrel, a silencer duct with a sound absorbing section is provided at the front end of said atomizing barrel for passing the mist of the charged minute particles out through said silencer duct, wherein said silencer duct comprises an outer tube and a perforated inner tube, and said sound absorbing section is defined by a sound absorber held between said outer tube and said inner tube, and wherein said inner tube is formed at its peripheral wall with an aperture, and said aperture extends from said sound absorber to an inside of the inner tube.

2. An electrostatically atomizing device as set forth in claim 1, wherein said atomizing barrel is formed with an air inlet for introducing an outside air, and said silencer duct is in the form of an attachment detachable to said atomizing barrel.

3. An electrostatically atomizing device as set forth in claim 1, wherein said sound absorber is formed in its interior with a sound reflector.

4. An electrostatically atomizing device as set forth in claim 1, wherein said silencer duct has its axis inclined with respect to an axis of said atomizing barrel.

5. An electrostatically atomizing device as set forth in claim 1, wherein said sound absorber is disposed to leave a cavity at its interface with said outer tube or said inner tube.

6. An electrostatically atomizing device as set forth in claim 5, wherein said cavity comprises a plurality of grooves extending along and being arranged circumferentially about the axis of said silencer duct.

7. An electrostatically atomizing device as set forth in claim 1, wherein said sound absorber is formed in its interior with a void.

8. An electrostatically atomizing device as set forth in claim 1, wherein said sound absorber comprises a sound absorbing sheet wound into a tubular shape.

9. An electrostatically atomizing device as set forth in claim 1, wherein said sound absorber comprises a first sound absorber and a second sound absorber which are configured to absorb sound of different frequency ranges.

10. An electrostatically atomizing device as set forth in claim 1, wherein said silencer duct has is one portion overlapped over the circumference of said atomizing barrel.

11. An electrostatically atomizing device as set forth in claim 1 or 2, wherein said opposed electrode is ring-shaped to be coaxial with a discharge end at the tip of said emitter electrode, the tip of said emitter electrode and said opposed electrode being arranged along. the axis of said atomizing barrel such that the mist of the charged minute particles discharged from the discharge end flows in an outlet passage defined along the axis of the atomizing barrel through the interior of said opposed electrode, and said silencer duct is formed with a discharge passage which crosses with said outlet passage.

12. An electrostatically atomizing device as set forth in claim 1, wherein said atomizing barrel has a uniform inside diameter along its axis, said silencer duct is formed at its rear end coupled to the front end of said atomizing barrel with an inlet port having a diameter larger than the inside diameter of said atomizing barrel, said silencer duct has its inside diameter smaller towards its outlet port at the front end of said silencer duct than at said inlet port.

13. An electrostatically atomizing device as set forth in claim 1 or 2, wherein said sound absorbing section comprises an expansion chamber of large diameter formed in an intermediate portion of the length of said silencer duct.

14. An electrostatically atomizing device as set forth in claim 1 or 2, wherein said sound absorbing section comprises a resonator chamber formed in an intermediate portion of the length of said silencer duct.

15. An electrostatically atomizing system comprising:

a housing accommodating therein said electrostatically atomizing device as defined in claim 1 or 2, and a fan configured to generate a forced air flow, said housing having a straight flow channel for directing said forced air flow, said electrostatically atomizing device being disposed in said flow channel, said silencer duct being configured to have a straight discharge channel flowing said charged minute particles, said discharge channel being inclined with respect to said flow channel.

16. An electrostatically atomizing system comprising:

a housing accommodating therein said electrostatically atomizing device as defined in claim 1 or 2, and a fan configured to generate a forced air flow, said housing having a straight flow channel for directing said forced air flow, said electrostatically atomizing device being disposed in said flow channel, said silencer duct being configured to have a straight discharge channel flowing said charged minute particles, said discharge channel being inclined with respect to said flow channel in communication therewith.

17. The electrostatically atomizing system as set forth in claim 1, wherein said inner tube is made of material capable of being electrically charged.

18. The electrostatically atomizing system as set forth in claim 1, wherein said sound absorber has degree of sound absorption which is higher than degree of sound absorption of said inner tube.

19. The electrostatically atomizing system as set forth in claim 1 wherein said silencer duct has one end which is communicated with a discharge port at a tip of said atomizing barrel, the mist of charged minute particles being produced in said atomizing barrel is discharged to an outside of the atomizing barrel from the discharge port of the atomizing barrel through the silencer duct.

* * * * *